US008375610B2

(12) United States Patent
Bearley

(10) Patent No.: US 8,375,610 B2
(45) Date of Patent: Feb. 19, 2013

(54) HANDHELD TELESCOPIC IRONING DEVICE

(76) Inventor: Patti Bearley, Loveland, OH (US)

( * ) Notice: Subject to any disclaimer, the term of this patent is extended or adjusted under 35 U.S.C. 154(b) by 295 days.

(21) Appl. No.: 12/665,839

(22) PCT Filed: Jun. 26, 2008

(86) PCT No.: PCT/US2008/068387

§ 371 (c)(1),
(2), (4) Date: Dec. 21, 2009

(87) PCT Pub. No.: WO2009/006223

PCT Pub. Date: Jan. 8, 2009

(65) Prior Publication Data

US 2010/0192427 A1 Aug. 5, 2010

Related U.S. Application Data

(60) Provisional application No. 60/937,739, filed on Jun. 29, 2007.

(51) Int. Cl.
*D06F 75/24* (2006.01)
*D06F 75/30* (2006.01)
*A45D 1/04* (2006.01)

(52) U.S. Cl. ..... 38/85; 38/144; 132/269

(58) Field of Classification Search ..... 38/77.8, 38/82, 144, 90, 15, 69, 85, 71; 132/224, 132/124, 129, 132, 226–229, 118, 269; 219/225, 219/222; D32/68–72
See application file for complete search history.

(56) References Cited

U.S. PATENT DOCUMENTS

| | | | | |
|---|---|---|---|---|
| 2,748,511 | A | 4/1954 | Pezza | |
| 3,703,042 | A | 11/1972 | Smith | |
| 4,101,757 | A * | 7/1978 | Van Dyck et al. | 219/225 |
| 4,219,724 | A | 8/1980 | Allvin | |
| 4,358,660 | A * | 11/1982 | Andis | 219/222 |
| 4,366,365 | A * | 12/1982 | Kunz et al. | 219/225 |
| 4,810,855 | A * | 3/1989 | Dassi et al. | 219/474 |
| 5,152,569 | A * | 10/1992 | Guiboche | 294/106 |
| 7,121,024 | B1 | 10/2006 | Clevenberg | |
| 7,188,442 | B2 | 3/2007 | Fernandez | |
| 7,600,520 | B2 * | 10/2009 | Choi | 132/224 |
| 2005/0011533 | A1 * | 1/2005 | Ruben | 132/230 |
| 2008/0156199 | A1 * | 7/2008 | Ekberg | 99/380 |
| 2008/0173322 | A1 * | 7/2008 | Leung | 132/232 |
| 2009/0260651 | A1 * | 10/2009 | Chan | 132/269 |

FOREIGN PATENT DOCUMENTS

| | | |
|---|---|---|
| JP | 11-226299 | 8/1999 |
| JP | 2000-61200 | 2/2000 |
| JP | 2001-162100 | 6/2001 |
| KR | 10-2007-0052140 | 5/2007 |

* cited by examiner

*Primary Examiner* — Ismael Izaguirre

(74) *Attorney, Agent, or Firm* — Alan G. Towner, Esq.; Pietragallo Gordon Alfano Bosick & Raspanti, LLP

(57) ABSTRACT

A handheld telescopic ironing device for pressing clothing, fabric and the like comprising two handles joined at the distal end with a pivotal hinge, each handle comprised of an elongated hollow outer handle housing and at least one elongated hollow inner handle housing concentrically aligned and telescopically mounted within outer handle housing with a locking means to hold the with inner handle housing and outer handle housing at extended or contracted lengths. Attached to the two handles are heads each having a pressing surface mounted on a hollow head housing so that the two pressing surfaces oppose each other. The telescopic ironing device is further comprised of at least one heating element disposed within one or more of internal cavities of the head housing and has an optional steam feature.

13 Claims, 5 Drawing Sheets

HANDHELD TELESCOPIC IRONING DEVICE

CROSS-REFERENCE TO RELATED APPLICATIONS

This application claims the benefit of International Application No. PCT/US2008/068387, filed Jun. 26, 2008, and U.S. Provisional Patent Application Ser. No. 60/937,739, filed Jun. 29, 2007, both of which are hereby incorporated by reference.

CLAIM TO PRIORITY

This application claims priority to U.S. Provisional Patent Application No. 60/937,739 filed Jun. 29, 2007. That application is incorporated by reference as if fully rewritten herein.

BACKGROUND OF INVENTION

The present invention relates generally to irons and more specifically to a handheld ironing device for pressing clothing, fabric and the like that does not require the use of an ironing board or pressing surface. In recent years, the technology with regard to producing wrinkle-free or permanent press fabrics has greatly improved and consequently, many consumers do not routinely press their clothing. Nevertheless, there still exist many fabrics that become extensively wrinkled after being laundered or through use or storage. Thus a need still exists to occasionally resort to ironing or pressing certain clothing or other fabrics and similar materials to eliminate wrinkles. However, conventional irons and ironing boards are bulky and their use is both cumbersome and time consuming, requiring ample space for both use and storage. Therefore, conventional irons and ironing boards are not very suitable for persons living in small quarters with little storage space or for individuals who are traveling or living in temporary locations.

Various types of handheld portable irons which eliminate the need to use an ironing board or other pressing surface for ironing have been disclosed in the prior art. See for example, U.S. Pat. Nos. 2,748,511; 3,703,042; and 4,219,724. Each of these patents disclose a handheld iron with two pivotally attached pressing surfaces which can be pivoted into contact through actuation of a handle. A major drawback of these devices is that the pivotal nature of the connection between the pressing surfaces greatly limits the displacement between the two pressing surfaces near the connection point and additionally limits the length of the fabric that can be inserted between the pressing surfaces. Thus, these inventions would be of little utility when one desires to press the middle portions of a larger garment or piece of fabric, such as a suit coat.

Other devices disclosed in the prior art have attempted to solve this problem by allowing the bottom pressing surface to be removable as in U.S. Pat. No. 7,188,442, or allowing the pressing surfaces to pivot about the hinge so that they can be aligned in the same plane as in U.S. Pat. No. 7,121,024 B1. The disadvantage of these arrangements is that once the second pressing surface is either detached or pivoted into the same plane, the device no longer has a second pressing surface in a parallel plane which would provide a hard surface to press the fabric on. Thus, there exists a need for a handheld iron that eliminates the need for an ironing board by having two pivotally attached pressing surfaces but which also provides the ability to reach into the middle portions of larger garments.

It is an object of the present invention to provide a portable handheld pressing ironing device with pivotally attached pressing surfaces aligned in parallel planes which eliminates the disadvantages of the prior art by providing telescoping handles which can be lengthened to allow the pressing surfaces to reach further into the interior or middle portions of the fabric or other material that is being pressed.

For a better appreciation of the present invention and a more complete understanding of its attendant advantages, reference should be made to the following detailed description of the invention taken in conjunction with the accompanying drawings.

DESCRIPTION OF THE PREFERRED EMBODIMENTS

Figure 7:
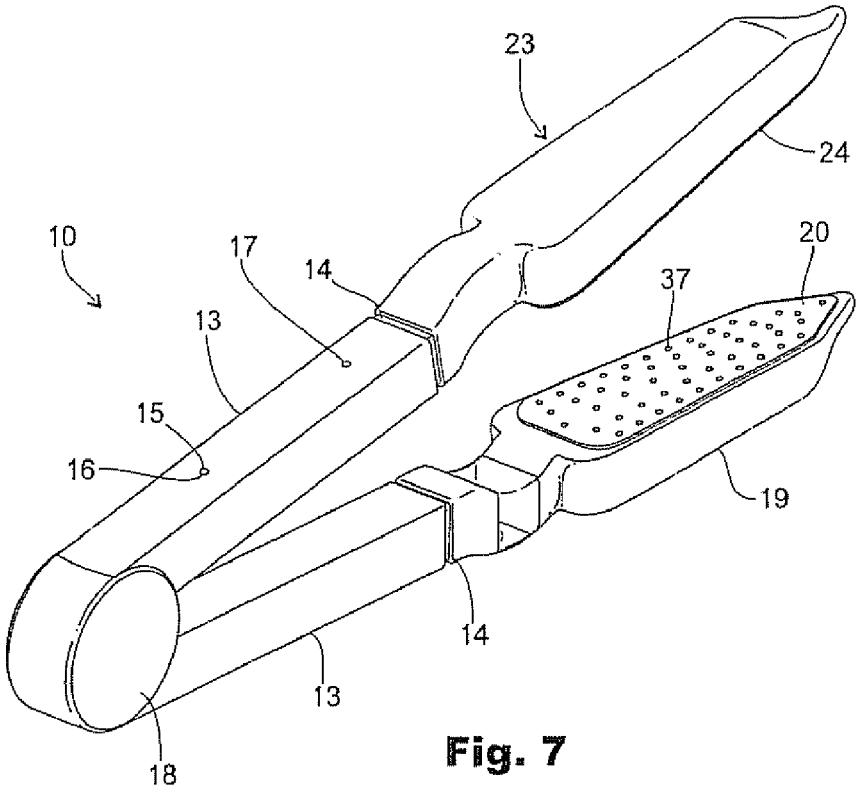
FIG. 7 is a bottom perspective view of the ironing device of the present invention showing the optional feature of holes in the pressing surface for emission of generated steam.
Figure 9:
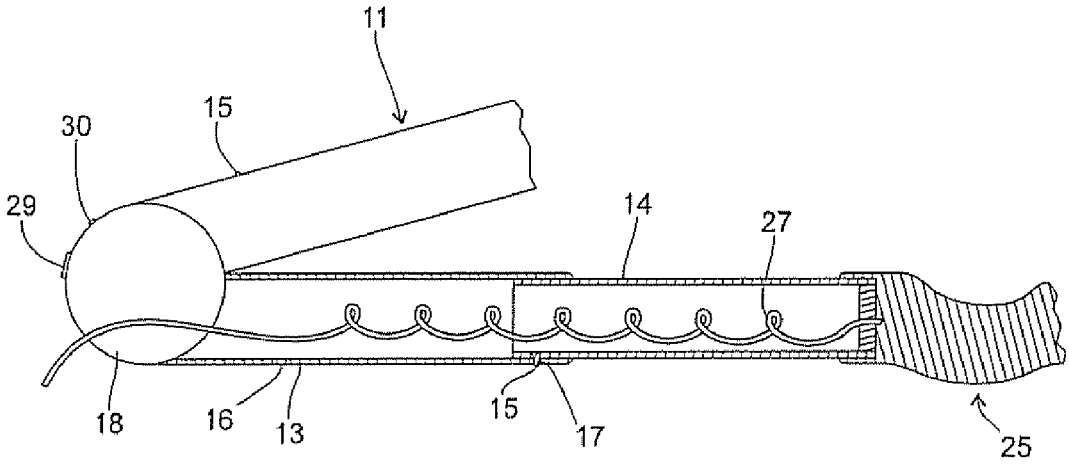
FIG. 9 is a partial cross-sectional rear view of the ironing device of the present invention showing the conductor cord coiled in the fully extended position.

One preferred embodiment of the handheld telescopic ironing device which forms the present invention 10 is described while initially referring to FIGS. 1-5 of the drawings. The ironing device comprises first handle 11 and second handle 12 comprised of an elongated hollow outer handle housing 13 and at least one elongated hollow inner handle housing 14 concentrically aligned and telescopically mounted within outer handle housing 13 and a locking means associated with inner handle housing 14 and outer handle housing 13 to lock inner handle housing 14 in selected relationship to outer handle housing 13. In this embodiment, the locking means is comprised of spring loaded button 15 affixed to the interior dorsal wall of inner handle housing 14 shown in FIGS. 9 and 10, with button 15 protruding through button hole 16 in outer handle housing 13. When button 15 is depressed, inner handle housing 14 is released and may be manually expanded to the fully extended position as shown in FIG. 9, where button 15 is aligned to protrude through second button hole 17 in outer handle housing 13 thereby locking the handle into the fully extended position. In an exemplary form, the overall length of the ironing device 10 from tip to tip is approximately twelve inches in the fully contracted position (see FIGS. 1 and 7) and approximately sixteen inches in the fully extended position (see FIGS. 5 and 9). However, these lengths are exemplary only and the ironing device 10 of the present invention may have other lengths in the fully contracted and extended positions without departing from the spirit and scope of the present invention as a handheld ironing device.

It is also understood that the locking device may consist of a number of other known expedients for selectively adjusting the internal handle housing member or members relative to the outer housing member in a series of adjustable positions between fully extended and fully contracted positions as will be understood in the art. First handle 11 and second handle 12 are joined by pivotal hinge 18 at the distal end as is conventional in the art and allows the two handles to pivot between open and closed positions.

Figure 4A:
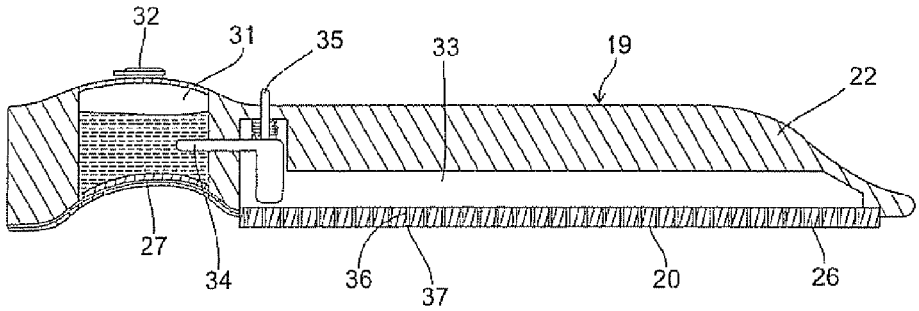
FIG. 4A is a partial cross-sectional front view of the ironing device of the present invention.

Referring again to FIG. 1 and FIG. 4A, telescopic ironing device 10 is further comprised of first head 19 extending from first handle 11 having first pressing surface 20 mounted on a hollow first head housing 21 having first internal cavity 22, and second head 23 extending from second handle 12 having second pressing surface 24 mounted on a hollow second head housing 25 so as to oppose first pressing surface 20, with second head housing 25 having second internal cavity (not shown). In one preferred embodiment of the invention, the distal end of first head housing 21 and second head housing 25 arch outwardly from the plane of first pressing surface 20 and second pressing surface 24 so as to allow said pressing surfaces to be drawn around raised objects on the material being pressed such as buttons. Referring now to FIG. 4A, the telescopic ironing device is further comprised of at least one heating element 26 disposed within one or more of first internal cavity 22 and the second internal cavity (not shown).

Figure 1:
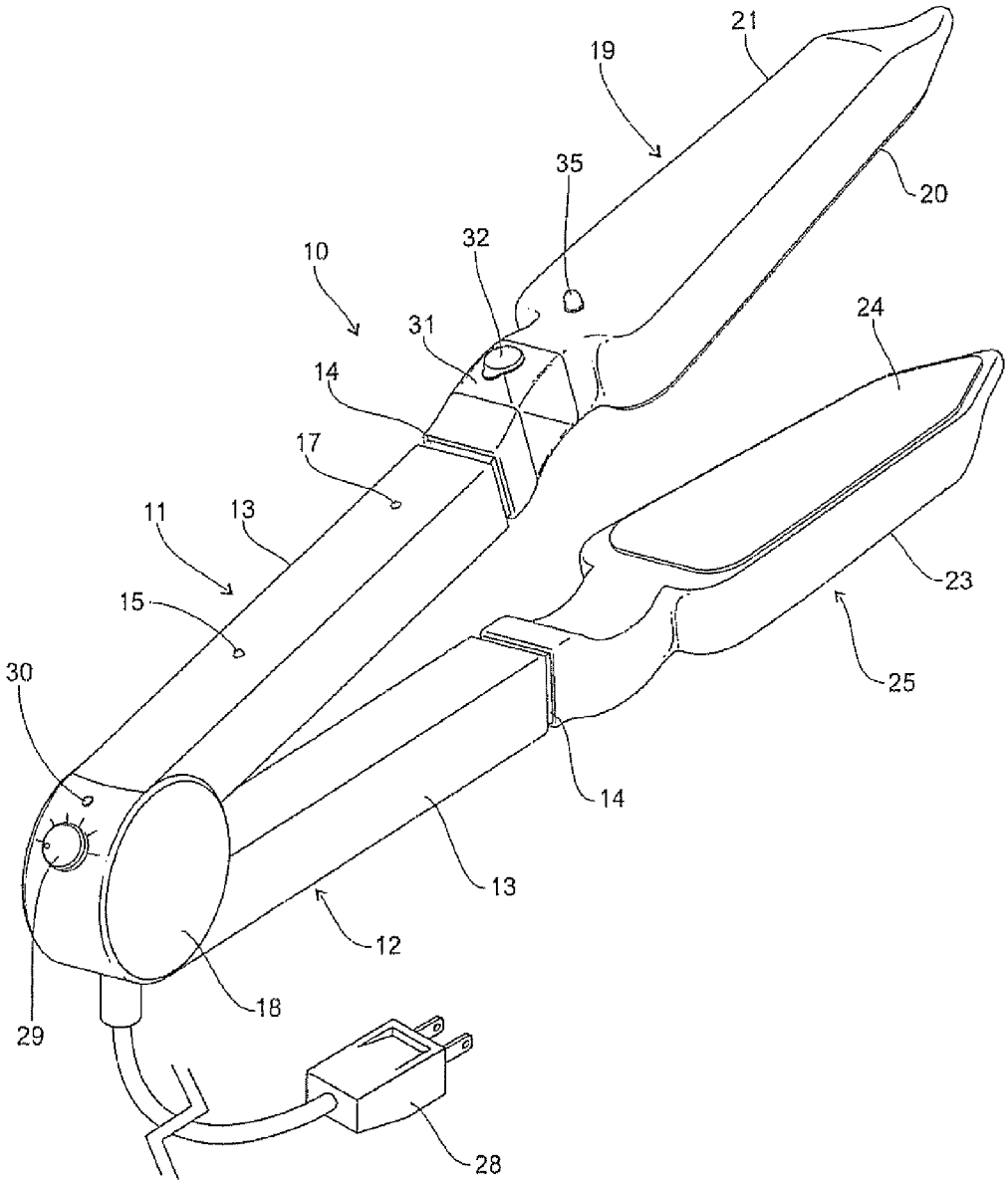
FIG. 1 is perspective view of the ironing device of the present invention with the telescopic handles in the fully contracted position.
Figure 2:
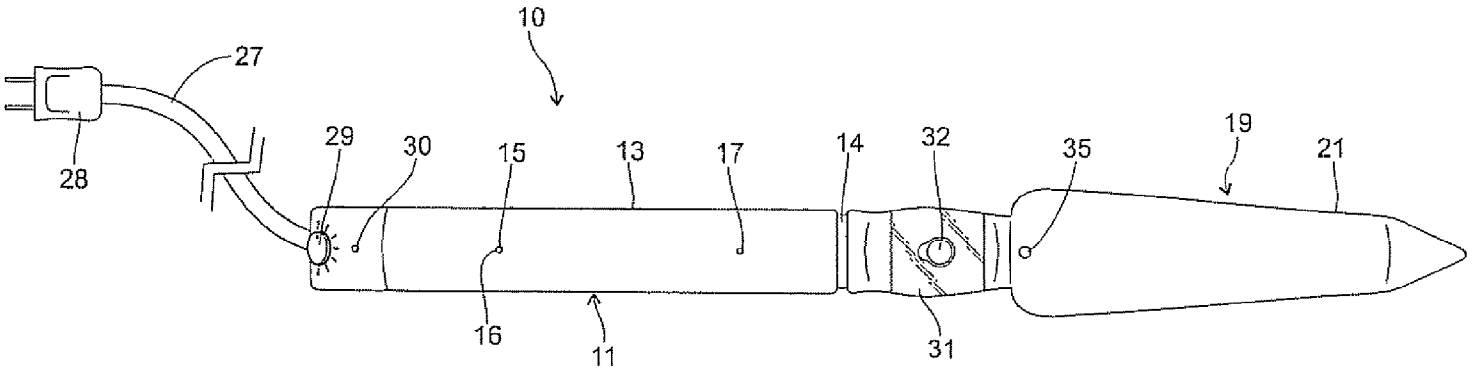
FIG. 2 is a top plan view of the ironing device of the present invention showing one of the handles in fully contracted position.
Figure 3:
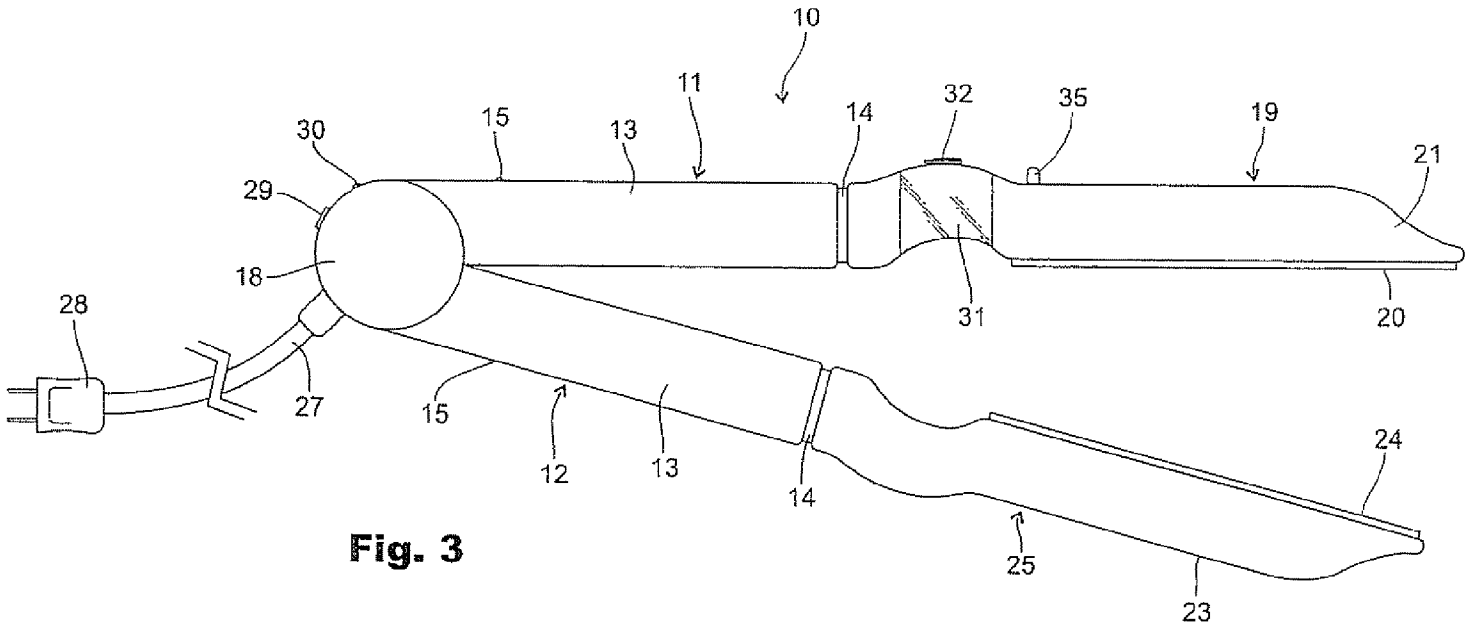
FIG. 3 is a rear elevational view of the ironing device of the present invention with the telescopic handles in fully contracted position.
Figure 8:
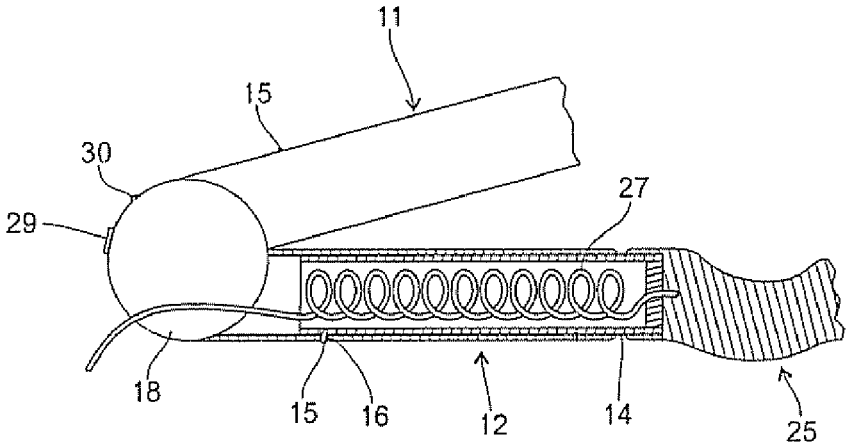
FIG. 8 is a partial cross-sectional rear view of the ironing device of the present invention showing the conductor cord coiled in the fully contracted position.

Referring to FIGS. 8 and 9, conductor cord 27 connected to heating element 26 through inner handle housing 14 in series with a switch means (not shown) as is conventional in the art and as shown in FIGS. 1-3, conductor cord 27 extends outwardly of first handle 11 and second handle 12 below pivotal hinge 18 and terminates in electrical plug 28. As shown in FIG. 9 the flexed length of conductor cord 27 is equal to slightly more than the combined length of inner tubular housing 14 and outer tubular housing 13. As shown in FIG. 8, conductor cord 27 is permanently pre-coiled into a retractable spring portion having a length of not greater than that of outer handle housing 13 so that conductor cord is free of slack at all times and at all adjustments of telescoping inner handle housing 14 and outer handle housing 13. It is also understood that the conductor cord may consist of a number of other known expedients for accommodating adjustments in length as said inner handle housing 14 and outer handle housing 13 are telescopically moved.

In one preferred embodiment of the present invention, adjustable thermostatic control 29, which is common in the art, is connected to the electrical circuit of the switch means to allow adjustment of the iron to different temperatures suitable for the type of fabric or material being pressed.

Figure 4B:
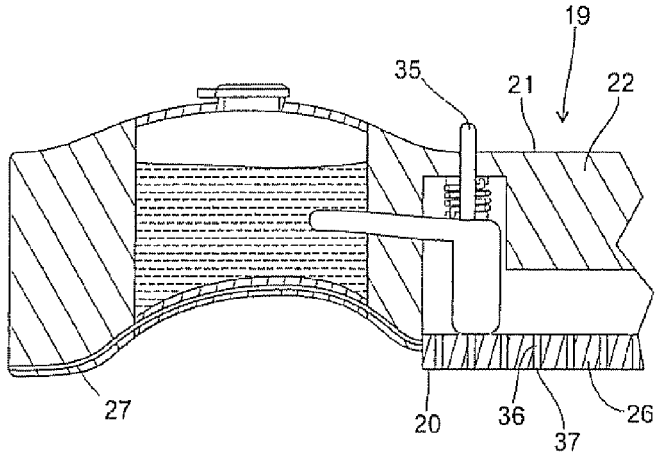
FIG. 4B is a partial cross-sectional enlarged view of a portion of FIG. 4A.
Figure 5:
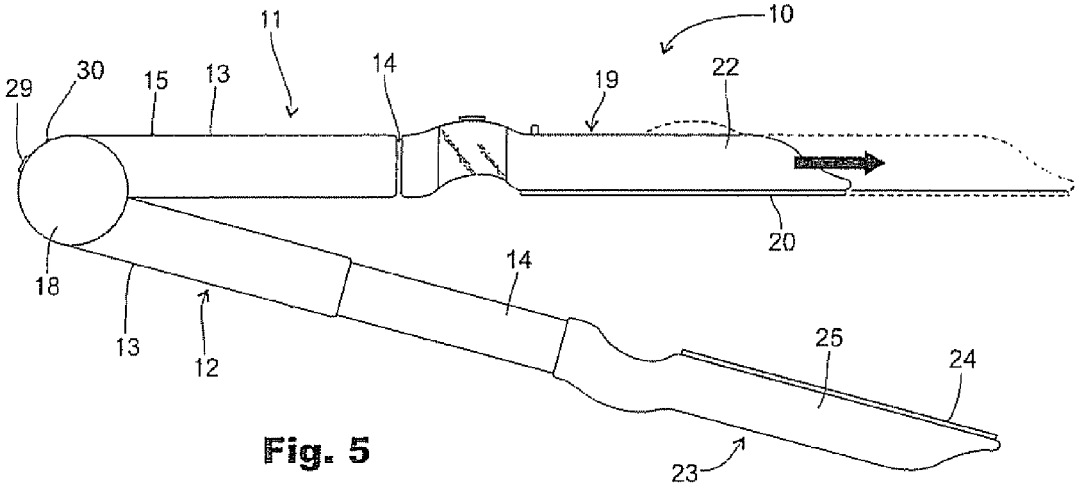
FIG. 5 is an explanatory rear elevation view of the ironing device of the present invention showing one of the handles in the fully extended position.
Figure 6:
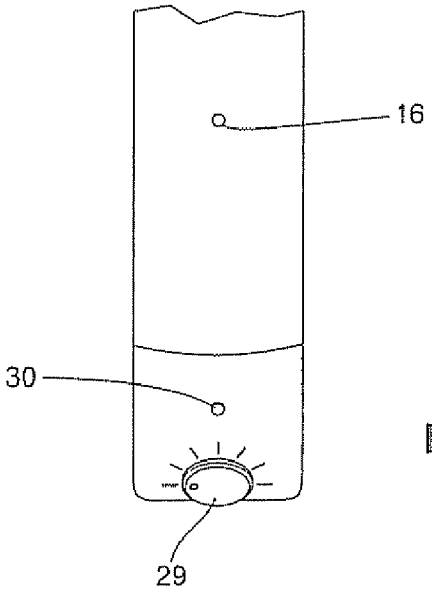
FIG. 6 is a partial top plan view of the ironing device of the present invention showing the optional features of an adjustable thermostatic control means and the indicator means.

In another preferred embodiment, small indicator lamp 30 is connected to the electrical circuit of the switch means for indicating whether heating element 26 is on or off. In still another preferred embodiment of the present invention, the telescoping ironing device is equipped with a steam producing means controlled by an actuator so that the iron can be used with or without steam. Referring to FIGS. 4A and 4B, in one preferred embodiment, the steam producing means is comprised of reservoir 31 for containing fluid which is refillable through water port 32, reservoir 31 being disposed in the distal portion of first head 19, a vaporizing chamber 33 disposed within first internal cavity 22 proximal to heating element 26, wick 34 communicating with reservoir 31 which can be advanced by steam actuator 35 into contact with the ventral wall of vaporizing chamber 33 which is heated by heating element 26 producing steam which escapes through pressing surface 20 through passage 36 connecting vaporizing chamber 33 with steam holes 37 shown in FIG. 7. In another preferred embodiment not shown in the Figures, the wick is replaced by a pump activated trigger which is employed to inject water into the vaporizing chamber. In this preferred embodiment, a pump activated by a trigger withdraws a metered volume of fluid from the water reservoir and places the fluid into the vaporizing chamber where the water is vaporized into steam and then escapes through the holes in the pressing surface. Still in other preferred embodiments, one or both of the first handle and first head and second handle and second head are equipped with the steam producing means. Additionally, those of ordinary skill in the art will realize that other sources of steam can also be used.

While embodiments and applications of this invention have been shown and described, it would be apparent to those skilled in the art that many more modifications than mentioned above are possible without departing from the inventive concepts herein. The invention, therefore, is not to be restricted except in the spirit of the appended claims.

What is claimed is:

1. A handheld telescopic ironing device comprising:

a first handle and a second handle each comprised of an elongated hollow outer handle housing and at least one elongated hollow inner handle housing concentrically aligned and telescopically mounted within said outer handle housing, a locking means associated with said inner and outer handle housings to lock said inner handle housing in selected relationship to said outer handle housing;

a first head extending from said first handle having a first pressing surface mounted on a first head housing with a first internal cavity;

a second head extending from said second handle having a second pressing surface mounted on a second head housing so as to oppose said first pressing surface, said second head housing having a second internal cavity;

at least one heating element disposed within one or more of the first internal cavity and the second internal cavity; and a pivotal hinge joining said first and second handles at the end opposite to said first and second heads and operable between an open and closed position, wherein a distal end of said first head housing and second head housing arches outwardly from the plane of said first pressing surface and second pressing surface.

2. The handheld telescopic ironing device of claim 1, further comprised of a conductor cord extending from said heating element through one or more of the first handle and second handle in series with a switch means and outwardly of said handles and terminating in an electrical plug; said conductor cord being capable of accommodating adjustments in handle length as said inner handle housing and said outer handle housing are telescopically moved.

3. The handheld telescopic ironing device of claim 2, further comprised of a steam producing means controlled by an actuator, said steam producing means emitting steam through holes in one or more of said first and second pressing surfaces.

4. The handheld telescopic ironing device of claim 2, wherein said conductor cord is further comprised of a flexed length equal to slightly more than the combined length of said inner and outer handle housings; said flexed length being permanently pre-coiled into a retractable spring portion having a length of not greater than that of said outer handle housing whereby the portion of said conductor cord within said first handle and second handle is substantially free of slack at all times and at all adjustments of said telescoping inner and outer handle housings.

5. The handheld telescopic ironing device of claim 2, wherein said switch means is further comprised of an adjustable thermostatic control means mounted on the dorsal surface of said first or second handle and coacting with said heating element for selectively adjusting the heat output thereof.

6. The handheld telescopic iron of claim 5, wherein said switch means is further comprised of an indicating means for indicating when said heating element is energized.

7. The handheld telescopic ironing device of claim 6, further comprised of a steam producing means controlled by an actuator, said steam producing means emitting steam through holes in one or more of said first and second pressing surfaces.

8. The handheld telescopic ironing device of claim 1, further comprised of a steam producing means controlled by an actuator, said steam producing means emitting steam through holes in one or more of said first and second pressing surfaces.

9. The handheld telescopic ironing device of claim 8, wherein said steam producing means comprises a refillable reservoir for containing fluid disposed in the one or more of said first or second head; a vaporizing chamber disposed within one or more of said first and second internal cavities proximal to said heating element; a pump activated by a trigger means; said pump withdrawing a metered volume of fluid from said reservoir and placing said metered volume of fluid into said vaporizing chamber and a passage connecting said vaporizing chamber with said holes so that generated steam is emitted from said holes.

10. The handheld telescopic ironing device of claim 8, wherein the steam producing means comprises a refillable reservoir for containing fluid disposed in one or more of said first or second head; a vaporizing chamber disposed within one or more of said first or second internal cavities proximal to said heating element; a wick communicating with said reservoir and movable into and out of said vaporizing chamber by a steam actuator, and a passage connecting said vaporizing chamber with said holes so that generated steam is emitted from said holes.

11. A method of removing wrinkles from fabric and materials comprising:

providing a handheld telescopic ironing device having a first handle and a second handle each comprised of an elongated hollow outer handle housing and at least one elongated hollow inner handle housing concentrically aligned and telescopically mounted within said outer handle housing, a locking means associated with said inner and outer handle housings to lock said inner handle housing in selected relationship to said outer handle housing;

a first head extending from said first handle having a first pressing surface mounted on a first head housing with a first internal cavity;

a second head extending from said second handle having a second pressing surface mounted on a second head housing so as to oppose said first pressing surface, said second head housing having a second internal cavity;

at least one heating element disposed within one or more of the first internal cavity and the second internal cavity; and a pivotal hinge joining said first and second handles at the end opposite to said first and second heads and operable between an open and closed position;

situating a fabric article or material article between said pressing surfaces; and moving the pressing surfaces together by operation of said pivotal hinge to press said fabric article or material article with substantially uniform pressure between said pressing surfaces, wherein the handheld telescopic ironing device further includes a conductor cord extending from said heating element through one or more of the first handle and second handle in series with a switch means and outwardly of said handles and terminating in an electrical plug; said conductor cord being capable of accommodating adjustments in handle length as said inner handle housing and said outer handle housing are telescopically moved.

12. A handheld telescopic ironing device comprising:

a first handle and a second handle each comprised of an elongated hollow outer handle housing and at least one elongated hollow inner handle housing concentrically aligned and telescopically mounted within said outer handle housing, a locking means associated with said inner and outer handle housings to lock said inner handle housing in selected relationship to said outer handle housing;

a first head extending from said first handle having a first pressing surface mounted on a first head housing with a first internal cavity;

a second head extending from said second handle having a second pressing surface mounted on a second head housing so as to oppose said first pressing surface, said second head housing having a second internal cavity;

at least one heating element disposed within one or more of the first internal cavity and the second internal cavity;

a conductor cord extending from said at least one heating element through one or more of the first handle and second handle in series with a switch means and outwardly of said handles and terminating in an electrical plug, said conductor cord being capable of accommodating adjustments in handle length as said inner handle housing and said outer handle housing are telescopically moved; and a pivotal hinge joining said first and second handles at the end opposite to said first and second heads and operable between an open and closed position.

13. A handheld telescopic ironing device comprising:

a first handle and a second handle each comprised of an elongated hollow outer handle housing and at least one elongated hollow inner handle housing concentrically aligned and telescopically mounted within said outer handle housing, a locking means associated with said inner and outer handle housings to lock said inner handle housing in selected relationship to said outer handle housing;

a first head extending from said first handle having a first pressing surface mounted on a first head housing with a first internal cavity;

a second head extending from said second handle having a second pressing surface mounted on a second head housing so as to oppose said first pressing surface, said second head housing having a second internal cavity;

at least one heating element disposed within one or more of the first internal cavity and the second internal cavity;

a pivotal hinge joining said first and second handles at the end opposite to said first and second heads and operable between an open and closed position; and a steam producing means controlled by an actuator, said steam producing means emitting steam through holes in one or more of said first and second pressing surfaces.

* * * * *